United States Patent [19]

Crump

[11] 4,248,360

[45] Feb. 3, 1981

[54] REMOTE CONTROL CAP FOR A SPRAY CAN

[76] Inventor: Robert F. Crump, 333 Guthrie Green, Louisville, Ky. 40202

[21] Appl. No.: 74,396

[22] Filed: Sep. 10, 1979

[51] Int. Cl.[3] ..... B65D 83/14

[52] U.S. Cl. ..... 222/174; 222/402.15; 239/532

[58] Field of Search ..... 239/280, 280.5, 281, 239/532; 222/174, 182, 402.13, 402.15

[56] References Cited

U.S. PATENT DOCUMENTS

| | | | |
|---|---|---|---|
| 2,960,260 | 11/1960 | Kutik | 222/402.15 X |
| 3,170,606 | 2/1965 | Boyer | 222/402.13 |
| 3,473,700 | 10/1969 | Batistelli | 222/174 |
| 4,013,231 | 3/1977 | Van Veldhoven | 222/402.15 X |

FOREIGN PATENT DOCUMENTS

| | | | |
|---|---|---|---|
| 2617716 | 11/1976 | Fed. Rep. of Germany | 222/402.13 |

*Primary Examiner*—David A. Scherbel

*Attorney, Agent, or Firm*—Wood, Herron & Evans

[57] ABSTRACT

A remote control cap that is adapted to snap fit onto a spray can's head, the cap being of a unitary or one piece molded plastic structure. The cap includes a lever arm connected to a snap-on collar by inherently resilient leaf springs, the leaf springs normally biasing the lever arm out of contact with the can's valve when the cap is assembled with the can. The cap also includes a pole socket connectable to an extension pole, and the lever arm is connectable to an extension cord at an end remote from the leaf spring end, thereby permitting the can's valve to be operated by depressing the lever arm against the leaf springs' bias from a position remote from the can.

4 Claims, 3 Drawing Figures

REMOTE CONTROL CAP FOR A SPRAY CAN

This invention relates to spray cans. More particularly, this invention relates to a remote control cap for a spray can.

Spray cans are, of course, very well known to the prior art. One typical use of spray cans is as packages for insecticide. The typical spray can includes a depressible discharge valve that, upon actuation by the user, permits the user to direct a spray of insecticide toward the offending insect. In certain situations, however, i.e., with certain insects, the insects tend to react violently upon being exposed to the insecticide spray. Such may cause some imagined or real safety concern to the user of the can. And in this type situation, the can's user may deem it desirable to be as far removed from the point of spray application as is possible. This is particularly the case, for example, in connection with applying an insecticide spray to a wasps' nest or to a hornets' nest or the like.

There is known to the prior art structure by which a spray can may be held remote from the can itself, and the spray can's valve then actuated by the user. In this connection, it is known to the prior art to mount the spray can on one end of an extension pole, and to provide a lever mechanism which may be operated by an extension cord to actuate the spray can valve for discharging the spray. These structures, however, typically are relatively costly to produce because of the somewhat complicated cap structures required to permit the remote control operation concept.

Therefore, it has been the primary objective of this invention to provide an improved remote control cap for a spray can that is of a one-piece molded plastic structure and, therefore, relatively inexpensive to manufacture. In accord with this objective, the improved remote control cap of this invention is basically comprised of a lever arm connected to a snap-on collar by inherently resilient leaf springs, the leaf springs normally biasing the lever arm out of contact with the can's valve when the cap is assembled with the can. The snap-on collar permits the cap to be latched onto the can's head in snap-fit fashion. The cap also includes a pole socket connectable to an extension pole, and the lever arm is connectable to an extension cord at an end remote from the leaf spring end, thereby permitting the can's valve to be operated by depressing the lever arm against the leaf springs' bias from a position remote from the can.

Other objectives and advantages of this invention will be more apparent from the following detailed description taken in conjunction with the drawings in which.

Figure 3:
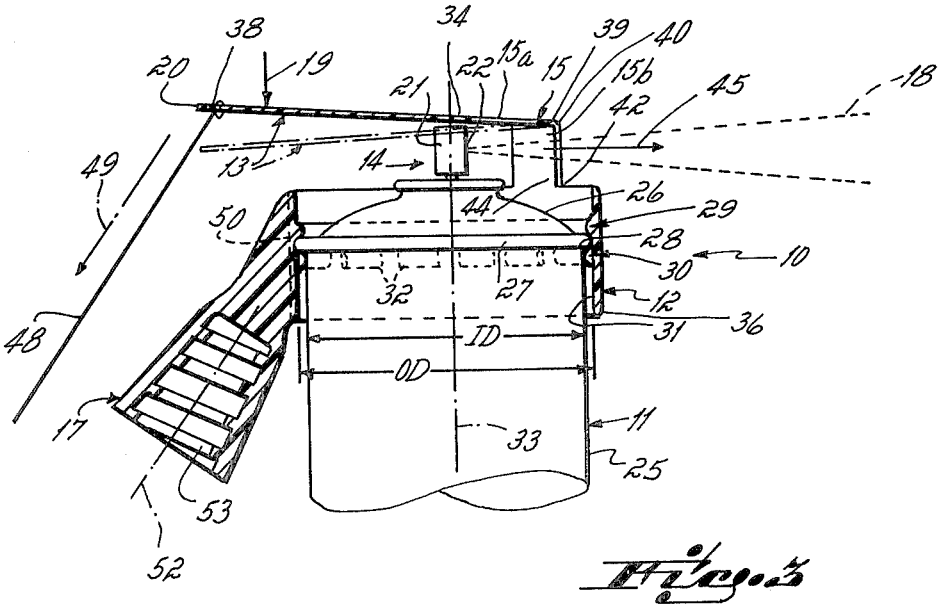
FIG. 3 is a cross-sectional view taken along line 3—3 of FIG. 2.

The remote control cap 10 for a spray can 11 in accord with the principles of this invention is basically comprised of a snap-on collar 12 by which the cap is snap-fit onto the spray can, a lever arm 13 by which the spray can's depressible injector valve 14 (not shown in detail) is actuated, resilient leaf springs 15, 16 that connect the lever arm to the snap-on collar, and an extension pole socket 17 also connected to the snap-on collar. This cap is of an integral or unitary one-piece configuration, and is preferably molded from a thermoplastic such as, for example, polyethelyne or polypropolyne. The cap is molded so that the inherently resilient leaf springs 15, 16, when the cap is in the non-use attitude, i.e., when no spray is being discharged from the can, positions the lever arm 13 out of contact with the can's depressible valve 14 as shown in solid lines in FIG. 3. When discharge of spray from the can 11 is desired, a downwardly exerted force 19 on the free end 20 of the lever arm 13 depresses that arm against the resilient spring bias of the integral leaf springs 15, 16 against the valve's plunger 21, thereby causing a spring 18 to issue from the valve's nozzle 22, thereby causing a spring 18 to issue from the valve's nozzle 22, see phantom line position as shown in FIG. 3.

The remote control cap 10, more specifically, includes the cylindrical collar 12 which is sized to fit closely about the spray can's cylindrical side wall 25. The spray can 11 includes a domed-shaped head portion 26 interconnected with the cylindrical side wall 25 portion by a beaded flange 27 located at the top edge 28 of the side wall. The snap-on collar 12 of the remote control cap 10 is adapted to cooperate with the can's beaded flange 27 through use of spaced ribs 29, 30 on the interior face 31 thereof. The collar's upper annular rib 29 is solid or unbroken, and the collar's lower annular rib 30 is comprised of spaced rib sections 32 which cooperate to form the intermittent or segmented annular rib 30. The upper 29 and lower 30 ribs are provided with an internal diameter ID, relative to the external diameter OD of the spray can's beaded flange 27, so as to permit a snap-fit of the snap-on collar 12 with the can 11 on that beaded flange 27 after the cap 10 has been coaxially aligned with the can's axis 33 and is pushed downwardly toward the assembled position shown in FIG. 3. During assembly of the cap 10 with the can 11, the segmented lower rib 30 permits the cap to be snapped into position with the can's beaded flange, and the solid upper rib 29 locates the cap in final assembly position, the cap's ribs 29, 30 cooperating with the can's flange 27 to hold the cap in assembled relation with the can.

Figure 1:
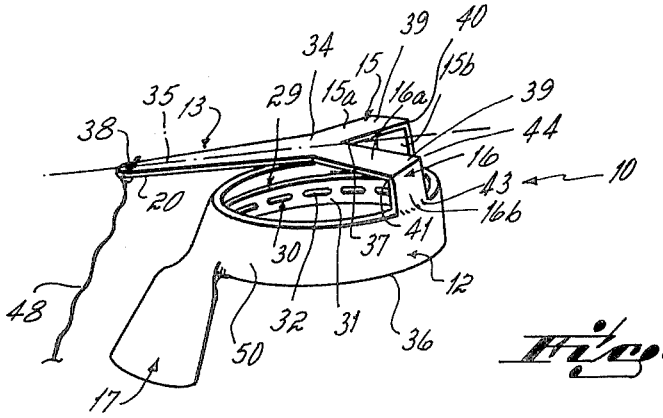
FIG. 1 is a perspective view illustrating a remote control cap for a spray can in accord with the principles of this invention.
Figure 2:
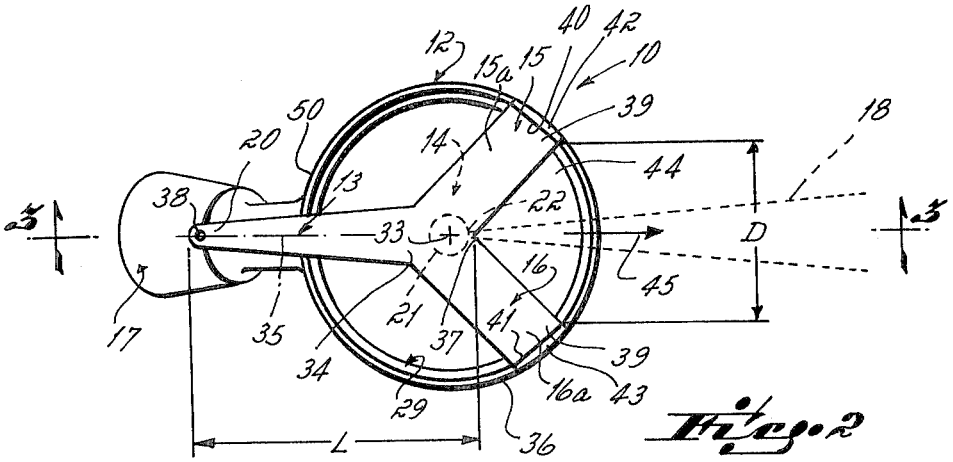
FIG. 2 is a top view illustrating the remote control cap in structural combination with a spray can of the aerosol type.

The remote control cap 10 also includes the lever arm 13, the center line 35 of which is positioned on a diameter 36 of the snap-on collar 12 and, thereby, also on a diameter of the spray can 11 after assembly of the cap therewith. The lever 13, at one end 34, is formed integral with a generally V-shaped leaf spring 15, 16 structure at the V's apex 37, and defines hole 38 at its free end 20, see FIG. 2. The free ends 39 of the leaf spring arms 15, 16 are formed integral with the snap-on collar 12, the collar, lever arm 13 and leaf spring thereby being formed of a one piece or unitary configuration. Note that each of the leaf spring arms 15, 16 is of a generally right angular configuration, the elbows 40, 41 of those arms 15, 16 cooperating with the arm sections **15*a*, 15*b*, 16*a*, 16*b*, respectively, to provide the leaf-type spring function. Also note particularly that the connection locations 42, 43 of the leaf springs 15, 16 with the connector collar 12 are positioned apart a distance D so as to define a port 44 by which spray 18 may exhaust from the spray can's nozzle 22 into the environment without being impeded by the cap's structure when the lever arms's center line is aligned with the spray direction 45 and when the leaf springs 15, 16 are positioned on opposite sides of the spray 18, see FIG. 2. The snap-on collar 12, being of a generally tubular configuration and extending substantially upward from the side wall of the can 11 in tubular fashion, thereby connects the leaf springs 15, 16 with the side wall of the can after assembly of the cap 10** with the can.

An extension cord 48 can be connected by the cap's user to the hole 38 in the free end 20 of the lever arm 13. And since the lever arm 13 is of a length L that it extends outwardly beyond the can's side wall 25 at its free end 20, the leverage obtained by a user upon pulling the cord downwardly in the direction shown by phantom arrow 49 is sufficient to pull the lever arm 13 downwardly against the valve's plunger 21 against the bias of the leaf springs 15, 16. The cap 10 also includes the extension pole socket 17 molded integral with the exterior face 50 thereof. The pole socket 17 is positioned on and connected to that section of the snap-on collar 12 which is positioned diametrically opposite the median position between leaf springs' connection location 42, 43. The pole socket defines a center line 52 that is outwardly and downwardly angled relative to the center line 33 of the can after assembly. The interior of the pole socket 17 may be threaded, as at 53, to receive the threaded end of an extension pole, not shown.

Note particularly that the entire cap's structure is of a one-piece configuration. Because of this structure, the cap 10 may be relatively inexpensively fabricated from a thermoplastic such as polyethylene or polyproplyene by known molding techniques. In addition to the fabrication cost advantage provided by the integral one-piece molded cap structure of this invention, this one-piece or unitary structural feature also ensures that component parts of the remote control cap will not become lost by the user upon storage of the cap 10 independent from a spray can 11.

In use of the remote control cap 10 of this invention, the cap is first installed on the head 26 of a spray can 11 by orienting the cap's snap-on collar 12 into coaxial relation with the can's axis 33, and telescoping the collar over the bead 27 by which the can's head is connected to the can's side wall 25. The collar 12 is forced downwardly over the bead 27 until the spaced ridges 32 of the lower rib 30 snap over the can's bead 27, the can's bead thereby being trapped between the snap-on collar's solid upper rib 29 and segmented lower rib 30 due to the inherent flexible characteristics of the one-piece molded plastic collar. Subsequently, the collar 12 is rotated relatively to the can's axis 33 until the exhaust valve's spray path 45 is oriented intermediate the leaf springs 15, 16 connections 42, 43 which connect the lever arm 13 with the snap-on collar 12. Such rotation is easily achieved since the snap-on collar's upper 29 and lower 30 ribs define a relatively smooth annular groove within which the can's bead 27 is received. With the cap 10 properly located relative to the can 11, and with an extension pole (not shown) received in the cap's pole socket 17 and an extension cord 48 attached to the lever arm 13, the cap and can are ready for use.

After assembly of the cap 10 with the can 11, and with no force 49 being exerted on the extension cord 48, the leaf springs 15, 16 retain the lever arm 13 out of contact with the valve's plunger 21 at all times. This ensures that spray 18 will not exhaust from the valve 14 until desired by the user. When it is desired to exhaust spray 18 from the can 11, the user need merely pull on the extension cord 48. The downward force 49 on the extension cord 48 causes the lever arm 13 to be forced downwardly, as shown by the force arrow 19, against the inherent resilience of the leaf springs 15, 16, thereby depressing the can's valve 14 and causing spray 18 to issue. Release of the downward force 49 on the extension cord 48 causes the inherently resilient leaf springs 15, 16 to bias the lever arm 13 upwardly into the non-spray attitude.

Having described in detail the preferred embodiment of my invention, what I desire to claim and protect by Letters Patent is:

1. A remote control cap for a spray can, said can including a head and a depressible spray control valve on said head, spray from said can being exhaustible in a direction generally perpendicular to the longitudinal axis of said can, said cap comprising a snap-on collar sized and configured to connect said cap to a bead on said can's head, a movable lever arm adapted to overlie said can's depressible spray valve, said lever arm being movable between a non-contact position and a contact position relative to said valve, said lever arm being normally biased into a non-contact position with said valve, and when said can is upright said lever arm being actuable into a contact position with said valve in response to a generally downward force, relative to ground, exerted on the free end of said lever arm, two spaced leaf-type springs connecting said lever arm and said snap-on collar, said leaf springs being of a generally V-shaped configuration with said lever arm being connected to said spring at the V apex of said springs, each of said leaf springs being integrally formed with said collar at one end and with said lever arm at the other end, and said leaf springs where connected with said collar being spaced one from the other a distance sufficient to permit spray from said can to exhaust therebetween through a port at least partially defined by said leaf springs for allowing spray from said can to be exhausted from said can in a direction generally perpendicular to the axis of said can, and a pole socket formed integral with said collar, said pole socket being adapted to receive an extension pole in assembly therewith, and said pole socket defining a center line located at an acute angle to the center line of said can when said cap and said can are assembled together, said snap-on collar, said lever arm, said leaf springs and said pole socket being fabricated of a one-piece structural configuration.

2. A remote control cap as set forth in claim 1, said collar comprising upper and lower ribs formed integral with the inside face of said collar, said ribs being positioned relative one to another to define an annular groove within which said bead may be received in snap-on relation.

3. A remote control cap as set forth in claim 2, said bead on said can's head being that bead at the top edge of said can's side wall, said upper rib being of a continuous unbroken configuration, and said lower rib being of a segmented configuration.

4. A remote control cap as set forth in claim 3, said pole socket including threads adapted to receive the threaded end of an extension pole in assembly therewith.

* * * * *